US006045034A

United States Patent [19]

Roccaforte et al.

[11] Patent Number: 6,045,034

[45] Date of Patent: Apr. 4, 2000

[54] PHOTO FOLDER WITH CASSETTE HOLDER

[75] Inventors: Harry I. Roccaforte, Chicago, Ill.; Daniel J. Boyle, Hartland, Wis.; Duane R. Mode, Bloomington, Minn.

[73] Assignee: Rock-Tenn Company, Norcross, Ga.

[21] Appl. No.: 09/040,199

[22] Filed: Feb. 27, 1998

[51] Int. Cl.[7] ..... B65D 27/08

[52] U.S. Cl. ..... 229/67.1; 229/67.3; 229/72; 206/455

[58] Field of Search ..... 229/301, 67.1, 229/67.3, 72; 206/455

[56] References Cited

U.S. PATENT DOCUMENTS

| | | | |
|---|---|---|---|
| 2,135,865 | 11/1938 | Winokar | 229/72 X |
| 3,111,256 | 11/1963 | Hiersteiner | 229/67.3 |
| 3,278,015 | 10/1966 | Bernstein | 229/301 X |
| 5,678,754 | 10/1997 | Kranz | 229/67.3 X |
| 5,788,074 | 8/1998 | Tanabe et al. | 206/455 |
| 5,806,754 | 9/1998 | Boyle | 229/67.3 X |
| 5,816,392 | 10/1998 | Kawagoe et al. | 206/455 X |
| 5,823,330 | 10/1998 | Werner et al. | 206/455 X |
| 5,833,059 | 11/1998 | Werner et al. | 206/455 X |

*Primary Examiner*—Jes F. Pascua
*Attorney, Agent, or Firm*—Schwegman, Lundberg, Woessner & Kluth PA

[57] ABSTRACT

A folder is provided for holding objects therein having at least one pocket. An expandable bottom bellows adjoins pocket and back panels along their respective bottom edges. A pair of expandable side bellows, along with the bottom bellows, permits expansion of the folder to accept objects within the pocket. An integral order panel is removably coupled with a front closure panel. A cassette holder is coupled with the front closure panel or the order panel, and is adapted to receive a cassette therein. Security panels are coupled with the cassette holder and fold over the cassette to retain the cassette securely within the cassette holder. Corner tabs are provided on the front closure panel for receiving the proof page therein. Flip tabs coupled with the cassette holder also secure proof page to the folder.

22 Claims, 5 Drawing Sheets

PHOTO FOLDER WITH CASSETTE HOLDER

FIELD OF THE INVENTION

The present invention relates generally to an apparatus for holding objects therein. More particularly, it pertains to a wallet with expandable sides.

BACKGROUND OF THE INVENTION

Folders for holding photo prints are currently produced from a relatively flimsy or flexible paper material having a single print pocket. The print pockets are sometimes expandable along the side edges but not the bottom edge of the folder. Some folders also include an expandable bottom end as well. Additionally, some folders have an extra pocket in front of the print pocket for holding the photo print negatives.

Conventional paper folders do not provide a sturdy, long-term storage container for photographs and negatives. The paper is generally flexible and flimsy and does not provide protection for the prints and negatives held within the folder. Conventional folders are especially susceptible to damage or failure when stuffed with as many as 80 prints and negatives. Additionally, the conventional paper material is not sturdy enough for a rigorous process of imprinting sophisticated promotional and advertising information on the folders which is necessary in today's competitive market.

The release of the Advanced Photo System (APS) has presented additional issues relating to packaging, handling, and ordering prints. The APS allows a user to choose from different types of prints, having differing sizes, including classic, HDTV, and panoramic. With APS, the film is provided in the form of a cartridge or a cassette. The film processing machines remove the film from the cassette and automatically replaces the film back in the cassette after processing. During the printing process, a printer automatically removes the film, prints, and replaces the film back in the cassette. After the film is processed, an index print is provided which displays all of the photos of the film. When ordering re-prints, the consumer must provide the negative to the photo processor, which film is in the form of the cassette.

One approach in providing a folder for the APS is an envelope having expandable sides, a single pocket, and a cassette holder is formed next to the pocket as part of the expandable side. One drawback is that the length of the envelope is extended by the size of the cassette, thereby rendering the envelope incompatible with conventional equipment of the photo industry. Another disadvantage is that the cassette is freely disposed within the cassette holder, and can become easily misplaced from the index print and/or the order card if the cassette is expelled from the cassette holder. The index print can also become misplaced if removed from the envelope.

Accordingly, what is needed is a print folder produced from a single unitary material and which is readily substituted for a conventional paper folder and compatible with existing automatic photo processing machines. What is further needed is a way to provide storage, handling of prints and re-prints for the APS. What is still further needed is a print folder which may be produced from either conventional print folder paper or from a relatively sturdy material such as paperboard suitable for long-term storage of objects therein and printing of sophisticated promotional material thereon and is biodegradable and recyclable.

SUMMARY OF THE INVENTION

A folder is provided which is constructed from a unitary blank of material and has at least one pocket therein for receiving and holding photo prints. A cassette holder is also provided with the folder which is adapted to retain a cassette therein.

The folder has a back panel and a pocket panel hingedly attached along their respective bottom edges, in one embodiment, by an expandable bottom bellows. The pocket and back panels are connected along their respective side edges, in another embodiment, by a pair of side bellows which permit the folder to expand to a predetermined thickness. The bottom bellows is expandable between the pocket and back panels. The construction of the bottom and side bellows permits free expansion of the folder when photo prints are inserted into the pocket. A front panel is hingedly attached to the back panel along a first edge of the back panel, where the front panel is adapted to fold over the pocket and at least a portion of the pocket panel. In addition, at least one cassette holder is coupled with at least a portion of the front panel of the folder. In another embodiment, an order panel is also included with the folder, where the order panel is removably coupled with the folder. Alternatively, at least one reinforcing panel is coupled with the pocket panel. In yet another embodiment, the cassette holder is coupled with the order panel.

The cassette holder optionally has an identification aperture therein. The identification aperture allows a consumer to easily view information contained on the cassette. In a further embodiment, the cassette holder includes at least one blocking panel, which prevents the cassette from slipping out of the cassette holder. Alternatively, the cassette holder can include at least one security panel disposed opposite to the blocking panel, which allows a consumer to secure the cassette in the cassette holder on both sides. The security panel optionally includes a retention tab which can be coupled with the security panel. The retention tab is adapted to retain at least a portion of an index print to the folder.

The folder can be produced from a single unitary material blank and has at least one pocket and at least one cassette holder. The folder is also compatible with existing automated photo processing machines. The folder may further be substituted for a conventional paper folder allowing for automatic or manual insertion of photo prints and cassettes into their respective pockets. The folder may also be fabricated from a blank of material which is no wider than the width necessary to form a conventional folder which conserves paper or paperboard material by reducing waste material. The folder may also be manufactured from conventional folder paper or from a more sturdy paperboard material.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from scope of the present invention. Therefore, the following detailed description is not to be taken in a limiting sense, and the scope of the present invention is defined by the appended claims.

Figure 1:
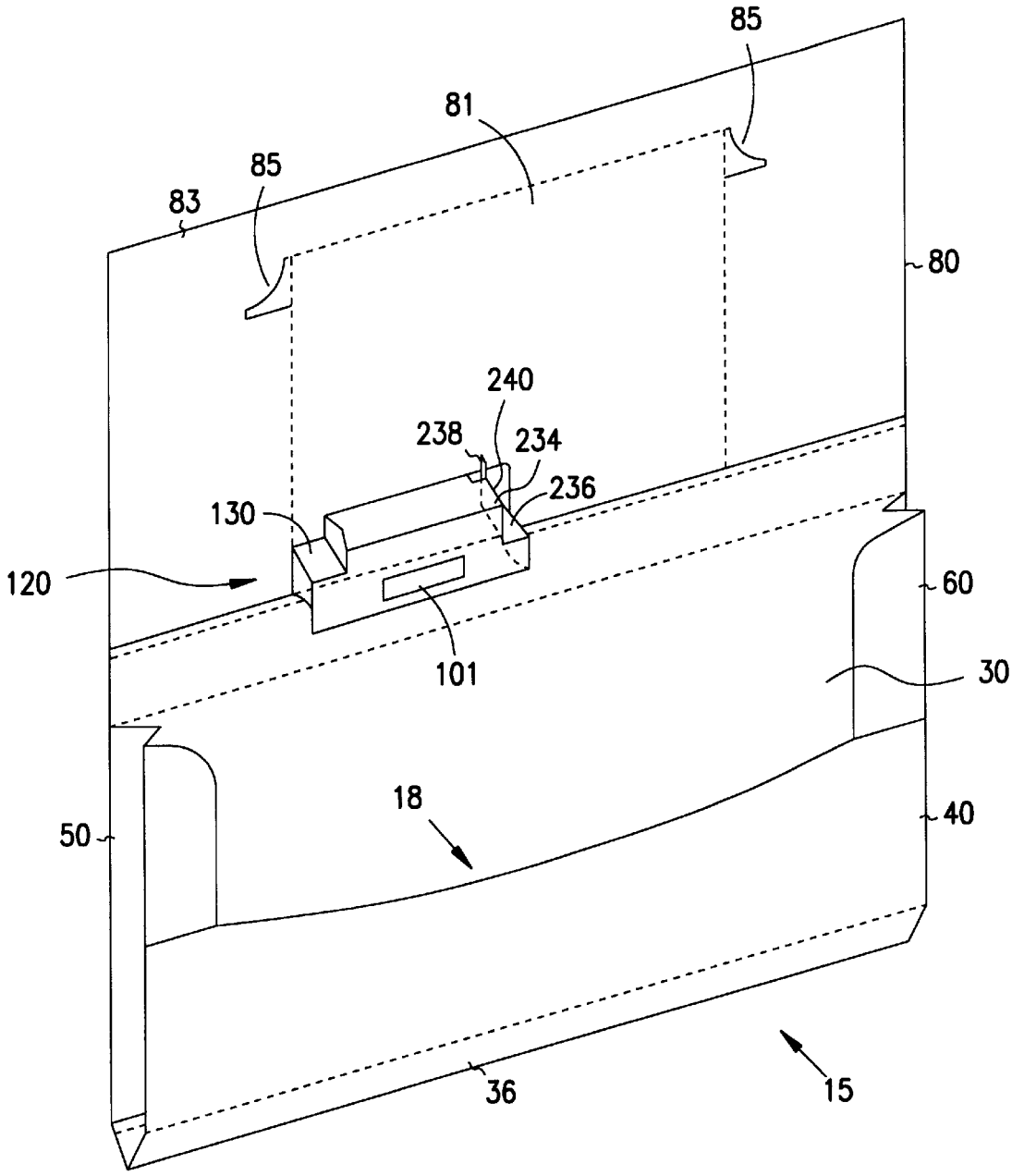
FIG. 1 is a perspective view illustrating a folder constructed in accordance with one embodiment of the present invention.

Referring now in more detail to the draws, FIG. 1 illustrates a folder 15 constructed in accordance with one embodiment of the present invention. The folder 15 is adapted to hold and store a stack of photo prints, an index print, and a cassette all within the folder 15. The folder has expandable bellows and includes a back panel 30, a front panel 80, and a pocket panel 40. In other embodiments, the folder 15 also includes an order panel 81, as will be further discussed below. The order panel 81, in one embodiment, is removable from the folder 15. In yet another embodiment, the folder includes at least one reinforcing panel 83.

A pair of expandable side bellows 50, 60 are disposed along opposite side edges of the folder 15, in combination with expandable bottom bellows 36, the expansion feature of the folder 15. A pocket panel 40 is disposed within the folder 15 between the first and second side bellows 50, 60 providing a pocket 18 therein. The expandable side and bottom bellows 50, 60 and 36, respectively, permit the pocket 18 to expand for receiving a stack of prints therein. At least one flap 85 is optionally provided with the folder 15 coupled either with the front panel 80 or with the order panel 81, where the flag 85 is adapted to retain a portion of the index print (not shown) therein. In another embodiment, at least one retention tab 238 is coupled with the cassette holder 120, and retains an index print (not shown) therein.

The folder 15 also includes a cassette holder 120. The cassette holder 120, which will be described in greater detail below, comprises a structure which is adapted to retain a cassette therein. The cassette holder 120 optionally includes at least one identification aperture 101 therein. In one embodiment, the cassette holder 120 is coupled to at least a portion of the front panel 80. In another embodiment, the cassette holder 120 is coupled to at least a portion of the order panel 81. The cassette holder 120 is coupled to the order panel 81 such that when the order panel 81 is removed from the folder 15, the cassette (not shown) is retained to the order panel 81.

In one embodiment, the cassette holder 120 also includes at least one blocking panel 130. The blocking panel 130 is hingedly coupled with the order panel 81, which prevents a cassette from being inserted past the blocking panel 130 to retain the cassette within the cassette holder 120.

In another embodiment, a first security panel 234 and a second security panel 236 are hingedly attached to the cassette holder 120. The security panels 234, 236 are adapted to fold down and close an opposite side of the cassette holder 120, such that a cassette contained therein is retained by both the first and second security panels 234, 236 and the blocking panel 130. In yet another embodiment, the first security panel 234 includes a retention tab 238. The retention tab 238 is adapted to retain at least a portion of an index print therein. In one embodiment, the retention tab 238 is positioned transverse to the front panel 80, as shown in FIG. 1, as the first security panel 234 is folded over a fold line 240.

Figure 2A:
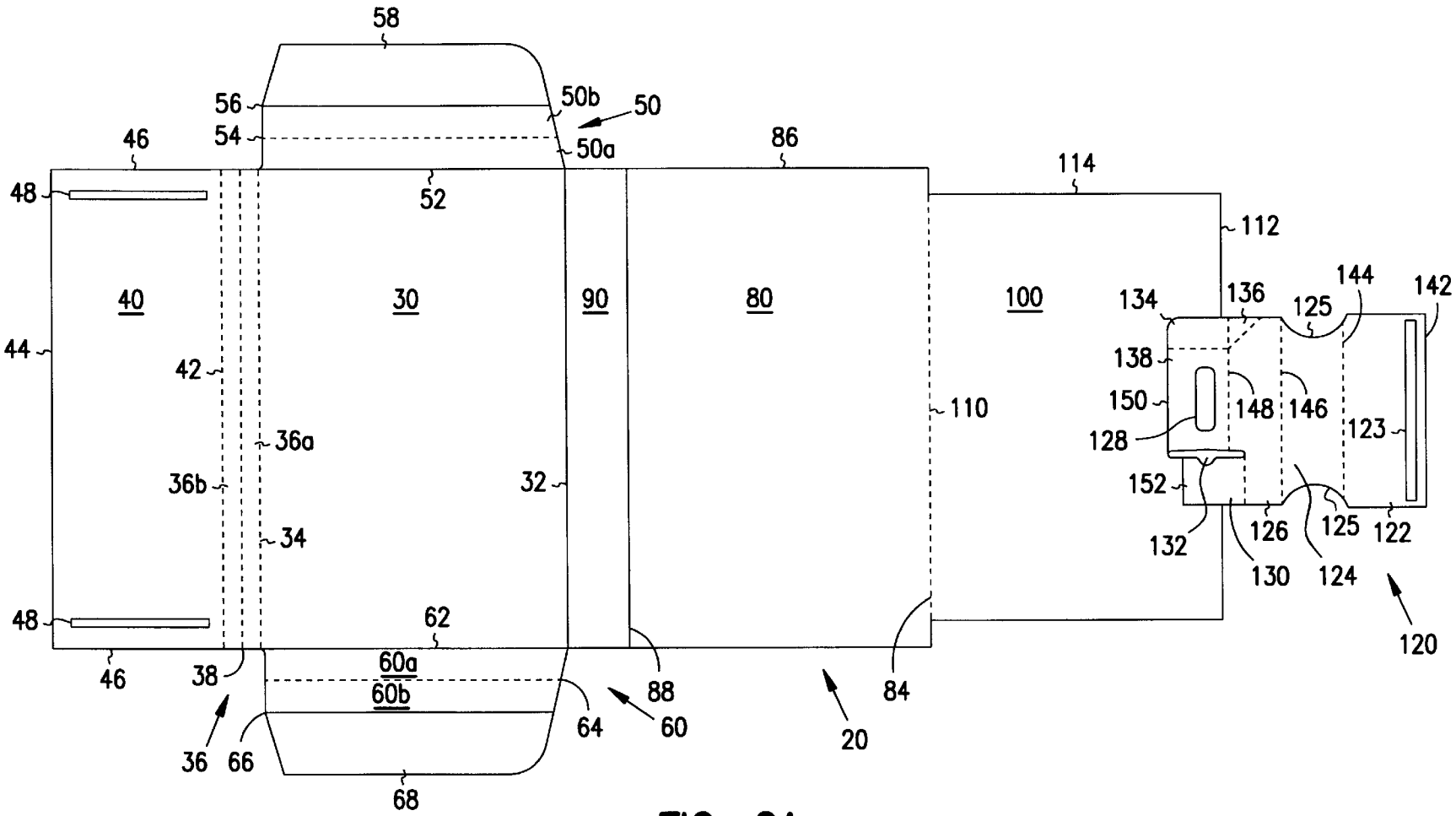
FIG. 2A is a first side elevational view illustrating a material blank for forming a folder constructed in accordance with one embodiment of the present invention.

FIG. 2A illustrates a material blank 20 which is suitable for constructing a folder similar to folder 15 of FIG. 1. The folder 15 is intended to be compatible with an existing automate photo processing machine. Therefore, the blank 20 may be produced from conventional paper product used to produce typical photo print folder. The blank 20, however, is preferably constructed from a relatively sturdy material such as paperboard or other suitable material. Paperboard is preferred over conventional paper because it is more sturdy and durable. A paperboard folder also provides better protection and long-term storage for the photo prints and print index held within the folder and accommodates print of advertising and promotional material on its exterior and interior surfaces. Paperboard is also compatible with existing automated photo processing machines and is, therefore, more desirable than paper folders, or other folders which are not compatible with automated photo processing machines.

In one embodiment, the blank 20 includes a back panel 30, a front panel 80, and a pocket panel 40. In one embodiment, the front panel 80 includes an extension panel 90. The back panel 30 has a top edge 32 defined by a fold line and a bottom edge 34 also defined by a score line. A bottom bellows 36 is hingedly attached to the back panel 30 along the bottom edge 34, and is hingedly attached to a bottom edge 42 of the pocket panel 40. A central score line 38 divides the bottom bellows 36 into a first bottom panel 36*a* defined between bottom edge 34 and central score line 38 and a second bottom panel 36*b* defined between bottom edge 42 and central score line 38.

A first side bellows 50 is hingedly attached along a first side edge 52 of the back panel 30 using a score line, a perforated line, a fold line, or an equivalent. A first attachment panel 58 is hingedly attached to a bellows edge 56, which in one embodiment is parallel to the first side edge 52. A central score line 54 is parallel to and disposed between the first side edge 52 and the bellows edge 56 and divides the first side bellows 50 into a first side panel 50*a* and a second side panel 50*b*. The first side panel 50*a* is disposed between the first side edge 52 and the central score line 54, and the second side panel 50*b* is disposed between the bellows edge 56 and the central score line 54.

Similarly, a second side bellows 60 is hingedly attached along a second side edge 62 of the back panel 30 using a score line, a perforated line, a fold line, or an equivalent. A second attachment panel 68 is hingedly attached to a bellows edge 66, which in one embodiment is parallel to the second side edge 62. A central score line 64, in another embodiment is parallel to and disposed between the second side edge 62 and the bellows edge 66 and divides the second side bellows 60 into a first side panel 60*a* and a second side panel 60*b*. The first side panel 60*a* is disposed between the second side edge 62 and the central score line 64, and the second side panel 60*b* is disposed between the bellows edge 66 and the central score line 64.

Figure 3:
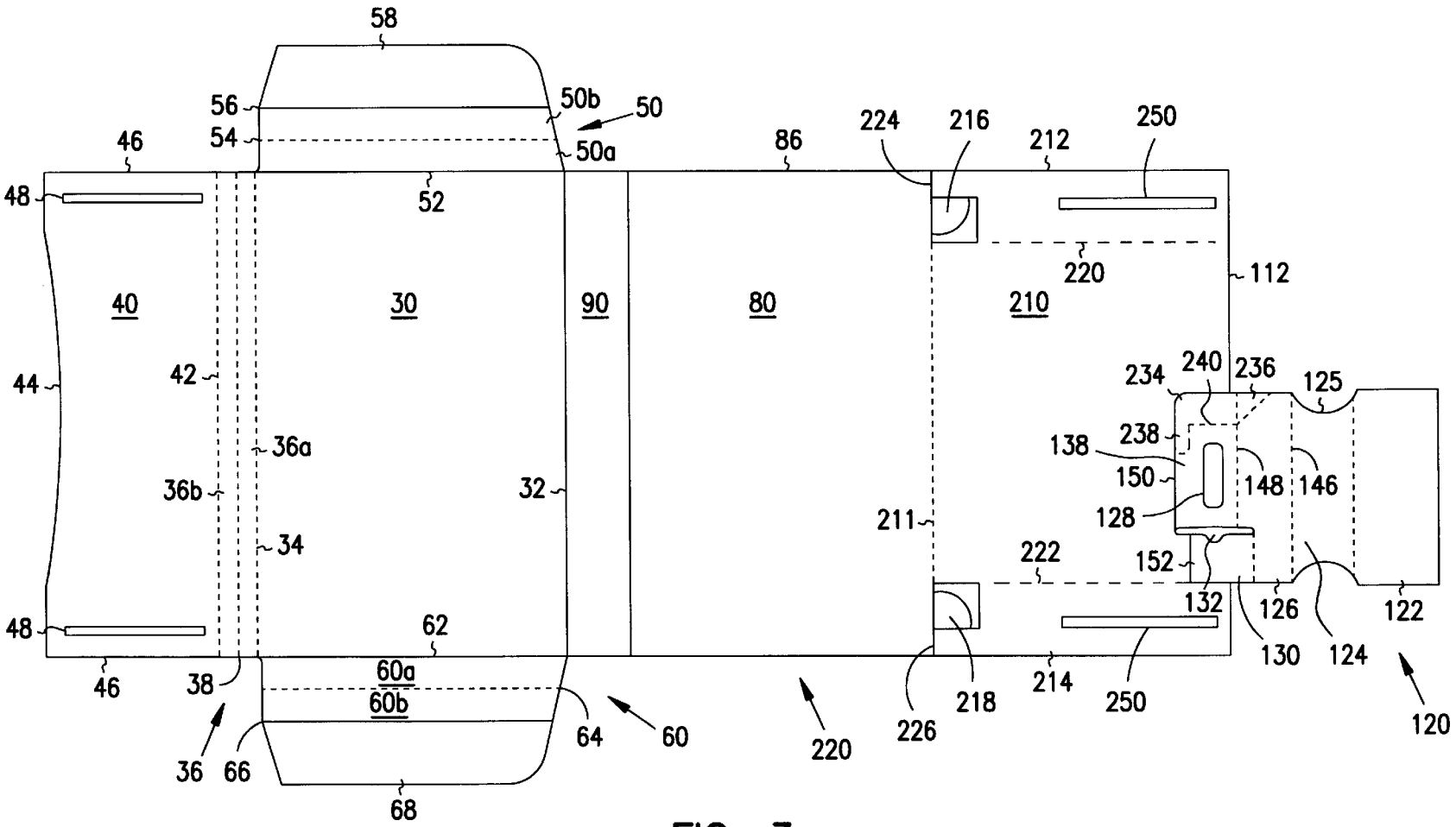
FIG. 3 is a first side elevational view illustrating a material blank for forming a folder constructed in accordance with one embodiment of the present invention.
Figure 4:
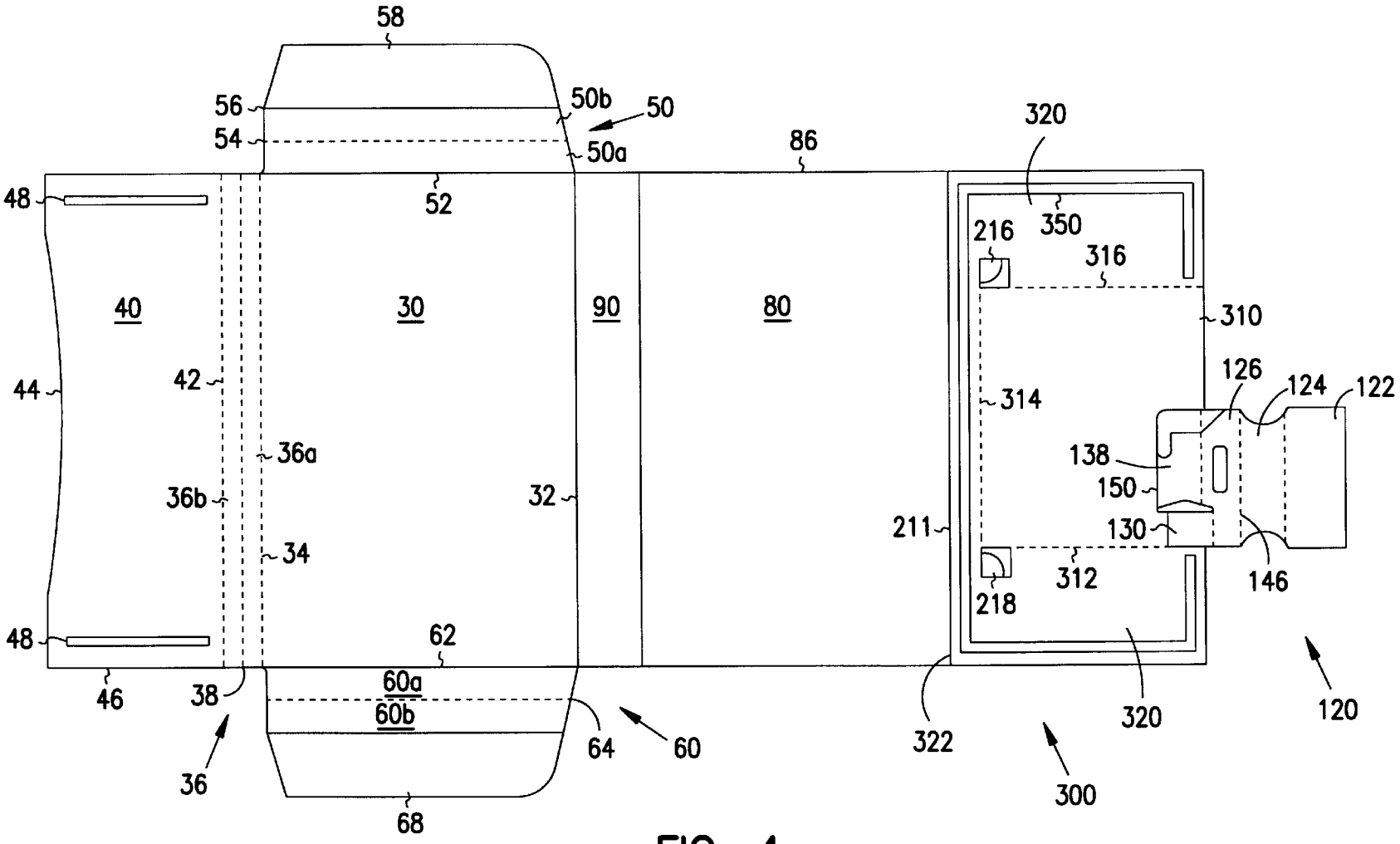
FIG. 4 is a first side elevational view illustrating a material blank for forming a folder constructed in accordance with another embodiment of the present invention.

The pocket panel 40 is hingedly attached to the bottom bellows 36 at the bottom edge 42. The pocket panel 40 also has a free edge 44 disposed opposite the bottom edge 42, which forms the top of the pocket when the folder 15 is assembled, as will be further discussed below. In one embodiment, the free edge 44 can taper toward the bottom bellows 36 for facilitating easy removal of prints from the folder 15. (FIGS. 3 and 4). The pocket panel 40 also has opposed side edges 46 which, in one embodiment, are generally parallel to one another. The pocket panel 40 is adapted to be coupled with attachment panels 58, 68. In one embodiment, adhesive strips 48 are disposed on the pocket panel proximate the side edges 46. Alternatively, the pocket panel 40 and the attachment panels 58, 68 can be coupled together in other manners.

In one embodiment, an order panel 100 is hingedly coupled with the back panel 30 at a tear edge 110. The tear edge 110 allows the order panel 100 to be removed from the back panel 30, which can be achieved in a number of different manners. In one embodiment, the order panel 100 is hingedly coupled to the back panel 30 using a score line. Alternatively, a perforated line, a fold line, or an equivalent can also be used.

The order panel 100, in one embodiment, is defined by the tear edge 100, side edges 114, and a free edge 112. Coupled to the order panel 100, which can also be coupled with the front panel 80, is a cassette holder 120. The cassette holder 120 comprises a structure to retain a cassette therein. In one embodiment, the cassette holder 120 is coupled adjacent to the free edge 112 of the order panel 100. The cassette holder 120 is coupled to the order panel 100 such that when the order panel 100 is removed from the folder 15, the cassette (not shown) is retained to the order panel 100. Alternatively, the cassette holder 120 can be coupled directly with the front panel 80, or at least a portion of the front panel 80, such as the extension panel 90.

Figure 2B:
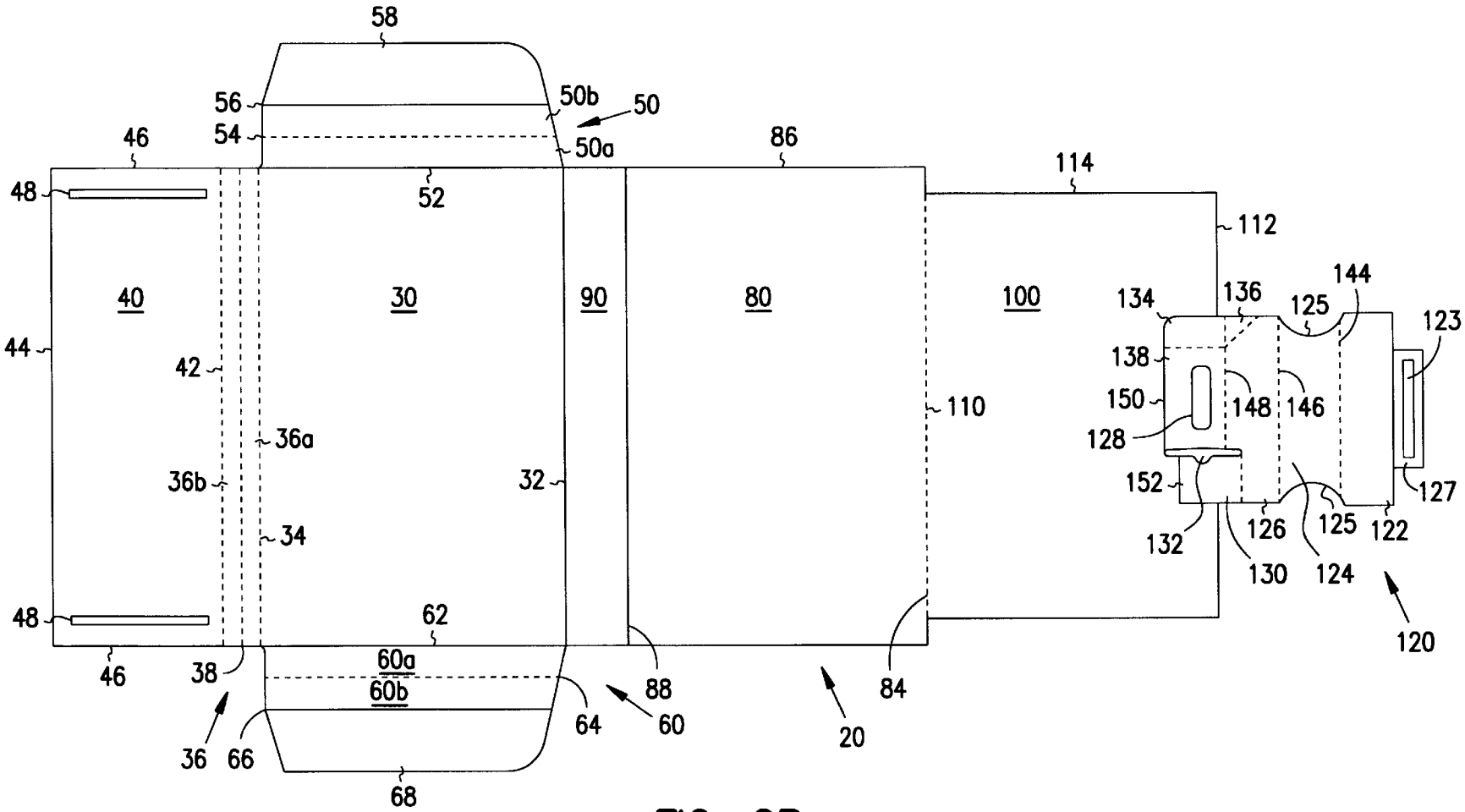
FIG. 2B is a first side elevational view illustrating a material blank for forming a folder constructed in accordance with another embodiment of the present invention.

In one embodiment, the cassette holder 120 comprises a first side panel 122, a second side panel 124, a third side panel 126, and a fourth side panel 138. The first side panel 122, in one embodiment, has a free edge 142 and is hingedly coupled with the second side panel 124 at edge 144. The first side panel 122, in another embodiment, has a strip of adhesive 123 disposed thereon. Alternatively, the cassette holder 120 includes an attachment panel 127 as shown in FIG. 2B, where the attachment panel 127 includes a strip of adhesive material 123 thereon.

The second side panel 124 is hingedly coupled with the first side panel 122 and the third side panel 126 at edge 146, where the second side panel 124 is disposed between edge 144 and edge 146. In one embodiment, the second side panel 124 has scalloped edges 125. The third side panel 126 is hingedly coupled to the fourth side panel at edge 148. The fourth side panel 138, in one embodiment, is hingedly coupled with the order panel 100 at edge 150. In another embodiment, the panels are hingedly coupled to each other at a score line. Alternatively, a perforated line, a fold line, or an equivalent can also be used. The fourth side panel 138, in yet another embodiment, has an identification aperture 128 therein. Alternatively, the identification aperture 128 can be located in other panels of the cassette holder 120.

Disposed adjacent the third side panel 126 and the fourth side panel 138 is a blocking panel 130. The blocking panel 130 is separated from the third side panel 126 and the fourth side panel 138, in one embodiment, by a cut out 132. The blocking panel 130 is hingedly coupled with the order panel 100, in one embodiment, at edge 152 which is disposed between edge 150 and edge 148, in another embodiment. When assembled, the blocking panel 130 prevents a cassette from being inserted past the blocking panel 130 to retain the cassette within the cassette holder 120, as discussed above. In another embodiment, a first security panel 134 and a second security panel 136 are hingedly attached to the fourth side panel 138 and the third side panel 126, respectively. In another embodiment, the first security panel 134 is also hingedly coupled with the second security panel 136. The security panels 134, 136 are adapted to fold down and close an opposite side of the cassette holder 120, such that a cassette contained therein is retained by both the first and second security panels 134, 136 and the blocking panel 130.

FIG. 3 illustrates another embodiment of a material blank 220 which is suitable for constructing a folder in accordance with another embodiment. In this configuration, the blank 220 has a back panel 30, a front panel 80, and a pocket panel 40, as discussed above. In addition, the blank 20 also has an order panel 210 coupled with the front panel 80 at tear edge 211. The order panel 210 also includes reinforcing panels 212, 214. The reinforcing panels 212, 214 are coupled with the order panel 210, in one embodiment, at score lines 220, 222 and are coupled with the front panel 80 at fold lines 224, 226. The reinforcing panels 212, 214 are adapted to attach to the front panel 80 when the order panel 210 is folded over the tear edge 211 and the fold lines 224, 226 when the folder is constructed. In one embodiment, the reinforcing panels 212, 214 have adhesive 250 disposed thereon. Alternatively, the adhesive can be disposed in other locations of the blank 220. The adhesive 250 assists in securing the reinforcing panels 212, 214 with the front panel 80.

The reinforcing panels 212, 214, in another embodiment, also include a first tab 216 and a second tab 218. The first tab 216 and second tab 218 are sized and positioned to receive an index print (not shown) therein. In another embodiment, the first tab 216 and the second tab 218 are each adapted to receive a comer of the index print (not shown), and are disposed proximate to fold lines 224, 226, respectively.

Coupled to the order panel 210 is a cassette holder 120. The cassette holder 120 comprises a structure to retain a cassette therein. In one embodiment, the cassette holder 120 is coupled adjacent to a free edge 112 of the order panel 210. The cassette holder 120 is coupled to the order panel 210 such that when the order panel 210 is removed from the folder 15, the cassette (not shown) is retained to the order panel 210.

In one embodiment, the cassette holder 120 comprises a first side panel 122, a second side panel 124, a third side panel 126, and a fourth side panel 138, similar to the cassette holder 120 discussed above. Disposed adjacent the third side panel 126 and the fourth side panel 138 is a blocking panel 130. The blocking panel 130 is separated from the third side panel 126 and the fourth side panel 138, in one embodiment, by a cut out 132. The blocking panel 130 is hingedly coupled with the order panel 210, in one embodiment, at edge 152 which is disposed between edge 150 and edge 148, in one embodiment. When assembled, the blocking panel 130 prevents a cassette from being inserted past the blocking panel 130 to retain the cassette within the cassette holder 120.

In another embodiment, a first security panel 234 and a second security panel 236 are hingedly attached to the cassette holder 120. In one embodiment, the first security panel 234 and the second security panel 236 are coupled with the fourth side panel 138 and the third side panel 126, respectively. In another embodiment, the first security panel 234 is also hingedly coupled with the second security panel 236. The security panels 234, 236 are adapted to fold down and close an opposite side of the cassette holder 120, such that a cassette contained therein is retained by both the first and second security panels 234, 236 and the blocking panel 130. In yet another embodiment, the first security panel 234 includes a retention tab 238. The retention tab 238 is adapted to retain at least a portion of an index print therein. In one embodiment, the retention tab 238 is positioned transverse to the front panel 80, as shown in FIG. 1, as the first security panel 234 is folded over a fold line 240.

FIG. 4 illustrates yet another embodiment of a blank 300 which is suitable for constructing another embodiment of the folder 15. In this configuration, the blank 300 has a back panel 30, a front panel 80, and a pocket panel 40, and cassette holder 120 as discussed above. In addition, the blank 300 also includes an order panel 310. In one embodiment, the order panel 310 is defined in part by tear edges 312, 314, and 316, where the order panel 310 is coupled with a reinforcing panel 320 at the tear edges 312, 314, and 316. The reinforcing panel 320, in one embodiment, is hingedly coupled with the front panel 80 at fold line 322. The reinforcing panel 320 is adapted to attach to the front panel 80 when the order panel 310 is folded over the fold line 322 when the folder 15 is constructed. In one embodiment, the reinforcing panel 320 has adhesive 350 disposed thereon. The adhesive 350 assists in securing the reinforcing panel 320 with the front panel 80.

The reinforcing panel 320, in another embodiment, also include a first tab 216 and a second tab 218. The first tab 216 and second tab 218 are sized and positioned to receive an index print (not shown) therein. In another embodiment, the first tab 216 and the second tab 218 are each adapted to receive a corner of the index print (not shown), and are disposed proximate to fold line 322.

To construct the folder 15 from the blank 20, each of first side bellows 50 and second side bellows 60 are folded along the first side edge 52 and the second side edge 62, respectively onto the back panel 30. The first and second side bellows 50, 60 are each folded along their respective central score lines 54, 64 such that side panels 50*a* and 50*b* overlap one another and side panels 60*a* and 60*b* overlap one another. The attachment panels 58 and 68 are then folded along bellows edges 56 and 66, respectively. The pocket panel 40 is folded about the central score line 38 such that the adhesive 48 adheres the pocket panel 40 with the attachment panels 58 and 68.

To form the cassette holder 120, the first, second, third and fourth side panel are folded over their respective edges to form the holder 120 as shown in FIG. 1. The first and second side panels 122 and 124 are folded over the edge 146, and the adhesive strip 123 secures the first side panel 122 or the attachment panel 127 to the order panel. The fourth side panel 138 is folded at edge 150 until it is approximately transverse to the order panel 100. As the fourth panel 138 is folded, the blocking panel 130 becomes disposed between the fourth side panel 138 and the second side panel 124, thereby blocking the passage through one side of the cassette holder 120. After a cassette (not shown) is inserted into the cassette holder 120, security panels 134, 136 are folded down to block passage through an opposite side of the cassette holder. For the embodiments shown in FIGS. 3 and 4, the retention tab 238 is moved away from the cassette holder 120 as the security panels are folded over, as shown in FIG. 1. In an alternative configuration, the order panel is folded over and secured with the front panel 80. The front panel 80 is then folded over the pocket 18, to thereby form the folder 15.

The folder advantageously provides a removable reorder card, where the cassette can be securely retained with the reorder card. The cassette is further secured within the wallet by a panel which automatically erects itself to prevent the cassette from inadvertently slipping out. A further benefit provided are security panels which further secure the cassette with the folder and the reorder panel. In another configuration, the retention tab provides additional securement for the index print provided after the APS processing. In addition, the identification aperture allows a consumer to easily identify the cassette.

It is to be understood that the above description is intended to be illustrative, and not restrictive. Many other embodiments will be apparent to those of skill in the art upon reviewing the above description. For instance, various features, such as the retention tab, can be interchanged between the many embodiments described herein. The scope of the invention should, therefore, be determined with reference to the appended claims, along with the full scope of equivalents to which such claims are entitled.

What is claimed is:

1. A folder adapted to hold and store prints, the folder comprising:

a back panel having two side edges;

a pocket panel having two side edges;

a pair of expandable side bellows connecting the pocket panel and the back panel at the side edges;

bottom bellows connecting the pocket panel and the back panel;

said back panel, said pocket panel, said pair of expandable side bellows, and said bottom bellows forming at least one pocket therein;

a front panel hingedly attached to said back panel along a first edge of the back panel, said front panel adapted for folding over the pocket and at least a portion of the pocket panel;

at least one cassette holder coupled with at least a portion of the front panel; and the at least one cassette holder extending from a first end to a second end, and having a passage through the first end and second end, where a cassette is insertable through the first end.

2. The folder as recited in claim 1, further comprising at least one removable order panel coupled with said back panel.

3. The folder as recited in claim 2, wherein said removable order panel is coupled with said front panel proximate to said cassette holder.

4. A folder adapted to hold and store prints, the folder comprising:

a back panel having two side edges;

a pocket panel having two side edges;

a pair of expandable side bellows connecting the pocket panel and the back panel at the side edges;

bottom bellows connecting the pocket panel and the back panel;

said back panel, said pocket panel, said pair of expandable side bellows, and said bottom bellows forming at least one pocket therein;

a front panel hingedly attached to said back panel along a first edge of the back panel, said front panel adapted for folding over the pocket and at least a portion of the pocket panel;

at least one cassette holder coupled with at least a portion of the front panel; and at least one flap coupled with the front panel, where the at least one flap includes retention features, the retention features sized and positioned to receive an index print therein.

5. The folder as recited in claim 4, further comprising at least one blocking panel coupled to the folder proximate to the cassette holder.

6. The folder as recited in claim 5, wherein each blocking panel is coupled with the cassette holder.

7. The folder as recited in claim 4, wherein the retention features include at least one retention tab coupled with the cassette holder, the retention tab sized and positioned to couple the index print to the folder.

8. The folder as recited in claim 4, wherein said expandable side bellows each comprise a first side panel, a second side panel, and an attachment panel.

9. The folder as recited in claim 4, wherein said pocket panel has adhesive material disposed thereon.

10. The folder as recited in claim 4, wherein said front panel, expandable side bellows, bottom bellows, back panel, pocket panel, and cassette holder are all fabricated from a unitary blank of material.

11. A folder adapted to hold and store photo prints and print negatives within separate pockets of the folder, the folder comprising:

a back panel having two side edges;

a pocket panel having two side edges;

a pair of expandable side bellows connecting the pocket panel and the back panel at the side edges;

bottom bellows connecting the pocket panel and the back panel;

said back panel, said pocket panel, said pair of expandable side bellows, and said bottom bellows forming at least one pocket therein;

a front panel hingedly attached to said back panel along a first edge of the back panel, said front panel for folding over the pocket and at least a portion of the pocket panel;

at least one order panel coupled with said front panel; and at least one cassette holder coupled with at least a portion of said order panel.

12. A folder adapted to hold and store prints, the folder comprising:

a back panel having two side edges;

a pocket panel having two side edges;

a pair of expandable side bellows connecting the pocket panel and the back panel at the side edges;

bottom bellows connecting the pocket panel and the back panel;

said back panel, said pocket panel, said pair of expandable side bellows, and said bottom bellows forming at least one pocket therein;

a front panel hingedly attached to said back panel along a first edge of the back panel, said front panel adapted for folding over the pocket and at least a portion of the pocket panel;

at least one order panel coupled with said front panel;

at least one cassette holder coupled with at least a portion of the front panel; and at least one reinforcing panel hingedly coupled with the front panel, the order panel being removably coupled with the at least one reinforcing panel.

13. A folder adapted to hold and store prints, the folder comprising:

a back panel having two side edges;

a pocket panel having two side edges;

a pair of expandable side bellows connecting the pocket panel and the back panel at the side edges;

bottom bellows connecting the pocket panel and the back panel;

said back panel, said pocket panel, said pair of expandable side bellows, and said bottom bellows forming at least one pocket therein;

a front panel hingedly attached to said back panel along a first edge of the back panel, said front panel adapted for folding over the pocket and at least a portion of the pocket panel;

at least one order panel coupled with said front panel;

at least one cassette holder coupled with at least a portion of the front panel; and the cassette holder having at least one identification aperture therein.

14. A one-piece material blank for forming a folder therefrom, the blank a back panel having a first side edge, a second side edge, and a top edge;

a front panel coupled with the top edge of said back panel;

a first set of side panels hingedly connected to the first side edge of the back panel;

a first attachment panel hingedly attached to the first set of side panels;

a second set of side panels hingedly connected to the second side edge of the back panel;

a second attachment panel hingedly attached to the second set of side panels;

a pocket panel disposed proximate to said back panel; bottom panels disposed between said pocket panel and said back panel, said bottom panels being hingedly attached to the pocket panel and the back panel;

an order panel hingedly connected to said front panel; and at least one reinforcing panel coupled with the order panel.

15. The blank for forming a folder as recited in claim 14, wherein the order panel is removably coupled with said front panel.

16. The blank for forming a folder as recited in claim 14, further comprising adhesive disposed on said reinforcing panel.

17. A one-piece material blank for forming a folder therefrom, the blank comprising:

a back panel having a first side edge and a second side edge; and a top edge a front panel coupled with the top edge of said back panel;

a first set of side panels hingedly connected to the first side edge of the back panel;

a first attachment panel hingedly attached to the first set of side panels;

a second set of side panels hingedly connected to the second side edge of the back panel;

a second attachment panel hingedly attached to the second set of side panels;

a pocket panel disposed proximate to said back panel;

bottom panels disposed between said pocket panel and said back panel, said bottom panels being hingedly attached to the pocket panel and the back panel;

an order panel hingedly connected proximate to said front panel; and at least one cassette holder panel coupled with the order panel.

18. The blank as recited in claim 17, further comprising at least one security panel coupled proximate the cassette holder panel.

19. The blank for forming a folder as recited in claim 17, further comprising a first tab and a second tab, the first and second tabs sized and positioned to retain an index print therein.

20. The blank for forming a folder as recited in claim 19, further comprising at least one retention tab hingedly coupled with the cassette holder and disposed proximate to the first tab and the second tab.

21. The blank for forming a folder as recited in claim 17, the cassette holder having at least one identification aperture therein.

22. A method for forming a folder, the method comprising the steps of:

providing a blank comprising:

a back panel having a first side edge and a second side edge;

a first set of side panels hingedly connected to the first side edge of the back panel, the first set of side panels having a first central score line disposed therein;

a first attachment panel hingedly attached to the first set of side panels to form a first side bellows;

a second set of side panels hingedly connected to the second side edge of the back panel, the second set of side panels having a second central score line disposed therein;

a second attachment panel hingedly attached to the second set of side panels to form a second side bellows;

a pocket panel disposed proximate to said back panel, the pocket panel having adhesive material disposed thereon;

bottom panels disposed between said pocket panel and said back panel, said bottom end panels hingedly attached to the bottom edge of the pocket panel and the back panel, the bottom end panels having a central bottom panel score line disposed therein;

an order panel hingedly attached to the front panel; and first, second, third, and forth side panels adapted to form a cassette holder, the first side panel being attached to said order panel;

folding the first set of side panels along the first central score such that the side panels overlap;

folding the first attachment panel towards the back panel over the side panels;

folding the second set of side panels along the second central score line such that the side panels overlap;

folding the second attachment panel towards the back panel over the second set of side panels;

folding the pocket panel over the back panel such that said pocket panel; adheres to the attachment panels;

folding the fourth side panel to couple with the order card;

folding the fourth side panel such that the fourth side panel is transverse to the order panel forming a cassette folder therein.

* * * * *

UNITED STATES PATENT AND TRADEMARK OFFICE

CERTIFICATE OF CORRECTION

PATENT NO.: 6,045,034

DATED: Apr. 4, 2000

INVENTOR(S) : Roccaforte et al.

It is certified that error appears in the above-identified patent and that said Letters Patent is hereby corrected as shown below:

In column 5, line 23, delete "100" and insert --110--, therefor.

In column 10, line 16, after "blank" insert --comprising:--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*